US006360392B1

(12) United States Patent
Malchow

(10) Patent No.: US 6,360,392 B1
(45) Date of Patent: Mar. 26, 2002

(54) LIQUIFIED GAS DRY-CLEANING MACHINE WITH IMPROVED AGITATION SYSTEM

(75) Inventor: Gregory L. Malchow, Oshkosh, WI (US)

(73) Assignee: Alliance Laundry Systems LLL, Ripon, WI (US)

( * ) Notice: Subject to any disclaimer, the term of this patent is extended or adjusted under 35 U.S.C. 154(b) by 0 days.

(21) Appl. No.: 09/338,292

(22) Filed: Jun. 23, 1999

Related U.S. Application Data

(63) Continuation-in-part of application No. 08/998,399, filed on Dec. 24, 1997, now Pat. No. 6,012,307.

(51) Int. Cl.[7] ..... D06B 1/02

(52) U.S. Cl. ..... 8/159; 68/18 C; 68/183; 68/207

(58) Field of Search ..... 68/18 C, 18 F, 68/207, 183; 8/158, 159

(56) References Cited

U.S. PATENT DOCUMENTS 3,889,496 A * 6/1975 Heyne
5,267,455 A * 12/1993 Dewees et al.
5,279,615 A * 1/1994 Mitchell et al.
5,417,768 A * 5/1995 Smith, Jr. et al.
5,467,492 A * 11/1995 Chao et al.
5,651,276 A * 7/1997 Purer et al.
5,669,251 A * 9/1997 Townsend et al.
5,759,209 A * 6/1998 Adler et al.
5,772,783 A * 6/1998 Stucker
5,784,905 A * 7/1998 Townsend et al.
5,822,818 A * 10/1998 Chao et al.
5,862,687 A * 1/1999 Jang
5,904,737 A * 5/1999 Preston et al.
5,925,192 A * 7/1999 Purer et al.

* cited by examiner

*Primary Examiner*—Frankie L. Stinson
(74) *Attorney, Agent, or Firm*—Leydig, Voit & Mayer, Ltd.

(57) ABSTRACT

A liquified gas dry-cleaning system having a pressure vessel for containing a liquid wash bath and a perforated basket rotatably supported within the pressure vessel for containing items during cleaning. For enhancing cleaning and the removal of solid particulate matter on the items to be cleaned, the basket has a plurality of radial mixing baffles fixed to the periphery of the rotary basket and a plurality of gas jet manifolds fixed to the baffles which are operable for directing pressurized jet streams of liquified gas into the basket for agitating the contained items and wash bath simultaneously with physical agitation by the mixing baffles. The dry-cleaning system has a successively operated air purge cycle prior to a dry cleaning cycle, which includes sealing the pressure chamber, introducing a gaseous form of the liquified gas which makes up the wash bath, rotating the basket so that items contained therein are turned and flexed to release at least a portion of any contained air therein, and venting the introduced gas and released air from the pressure vessel.

34 Claims, 5 Drawing Sheets

LIQUIFIED GAS DRY-CLEANING MACHINE WITH IMPROVED AGITATION SYSTEM

RELATED APPLICATION

This application is a continuation-in-part of U.S. application Ser. No. 08/998,399, filed Dec. 24, 1997 now U.S. Pat. No. 6,012,307.

FIELD OF THE INVENTION

The present invention relates to dry-cleaning systems and, more particularly, to a liquified gas dry-cleaning system having a cleaning vessel with improved means for agitating contained items for enhanced and more efficient cleaning.

BACKGROUND OF THE INVENTION

Known dry-cleaning processes consist of a wash, rinse, and draining/drying cycle with solvent recovery. During the dry-cleaning process, items, such as garments, are loaded into a basket disposed within a vessel and immersed in a dry-cleaning solvent that is pumped into the vessel from a base tank. Conventional dry-cleaning solvents include perchloroethylene (PCE), petroleum-based or Stoddard solvents, CFC-113, and 1,1,1-trichloroethane, all of which are generally aided by a detergent.

The use of these conventional solvents, however, poses a number of health and safety risks as well as being environmentally hazardous. For example, halogenated solvents are known to be environmentally unfriendly, and at least one of these solvents, PCE, is a suspected carcinogen. Known petroleum-based solvents are flammable and can contribute to the production of smog. Accordingly, dry-cleaning systems which utilize dense phase fluids, such as liquid carbon dioxide, as a cleaning medium have been developed. An apparatus and method for employing liquid carbon dioxide as the dry-cleaning solvent is disclosed in U.S. Pat. No. 5,467,492, entitled "Dry-Cleaning Garments Using Liquid Carbon Dioxide Under Agitation As Cleaning Medium". A similar dry-cleaning apparatus is also disclosed in U.S. Pat. No. 5,651,276.

These systems pose a number of other problems, particularly in relation to the high operating pressures necessary for maintaining the gas in a liquid state. Specifically, the cleaning vessel in a liquid carbon dioxide dry-cleaning system operates at between 700–850 psi under ambient temperature conditions. The dry-cleaning solvent functions to dissolve the soluble soils on the item. The insoluble soils, however, must be physically dislodged from the item, which typically required agitation of the items in the cleaning solvent during the wash and rinse cycles.

In dry-cleaning systems that utilize liquified gas as a cleaning solvent, it has been particularly difficult to effect agitation sufficient to clean items of extremely fine unsoluble soils, such as dirt or like particles three microns and less in size. Because of the high operating pressures under which the liquified gas must be maintained, care also must be taken to prevent damage to the goods from pressurized streams of liquified gas introduced into the cleaning vessel.

Furthermore, in liquified gas dry-cleaning systems it is necessary that the liquified gas be completely removed from the cleaned items, vaporized to separate the contaminants and foreign particulate matter, and reliquified for re-circulation through the system. The cycle time for such processing can be lengthy, thereby increasing the operating cost. The presence of air in the liquid carbon dioxide cleaning solvent, such as air that enters the cleaning solvent from items introduced into the system for cleaning, also can adversely affect the cleaning process. Heretofore methods of removing or venting such air have not been effective.

Accordingly, a need exists for an improved dry-cleaning system, and in particular, an improved liquified gas dry-cleaning system.

OBJECTS AND SUMMARY OF THE INVENTION

It is an object of the present invention to provide an improved liquified gas dry-cleaning system which enables faster cleaning and quicker solvent removal upon completion of the cleaning cycle.

Another object of the invention is to provide a liquified gas dry-cleaning system as characterized above that has an agitation system adapted for enhanced cleaning and shortened cycling times.

Still another object is to provide a liquified gas dry-cleaning system of the above kind that effects thorough agitation of items during the cleaning cycle without damage to relatively fragile garments and the like.

Yet another object is to provide a liquified gas dry-cleaning system of the foregoing type that is more effective for preventing contamination of the liquified gas cleaning solvent with air. A related object is to provide such a dry-cleaning system that is operable for more effectively removing air from the system prior to introduction of the liquified gas into the cleaning chamber.

Other objects and advantages of the invention will become apparent upon reading the following detailed description and upon reference to the drawings, in which:

Figure 1:
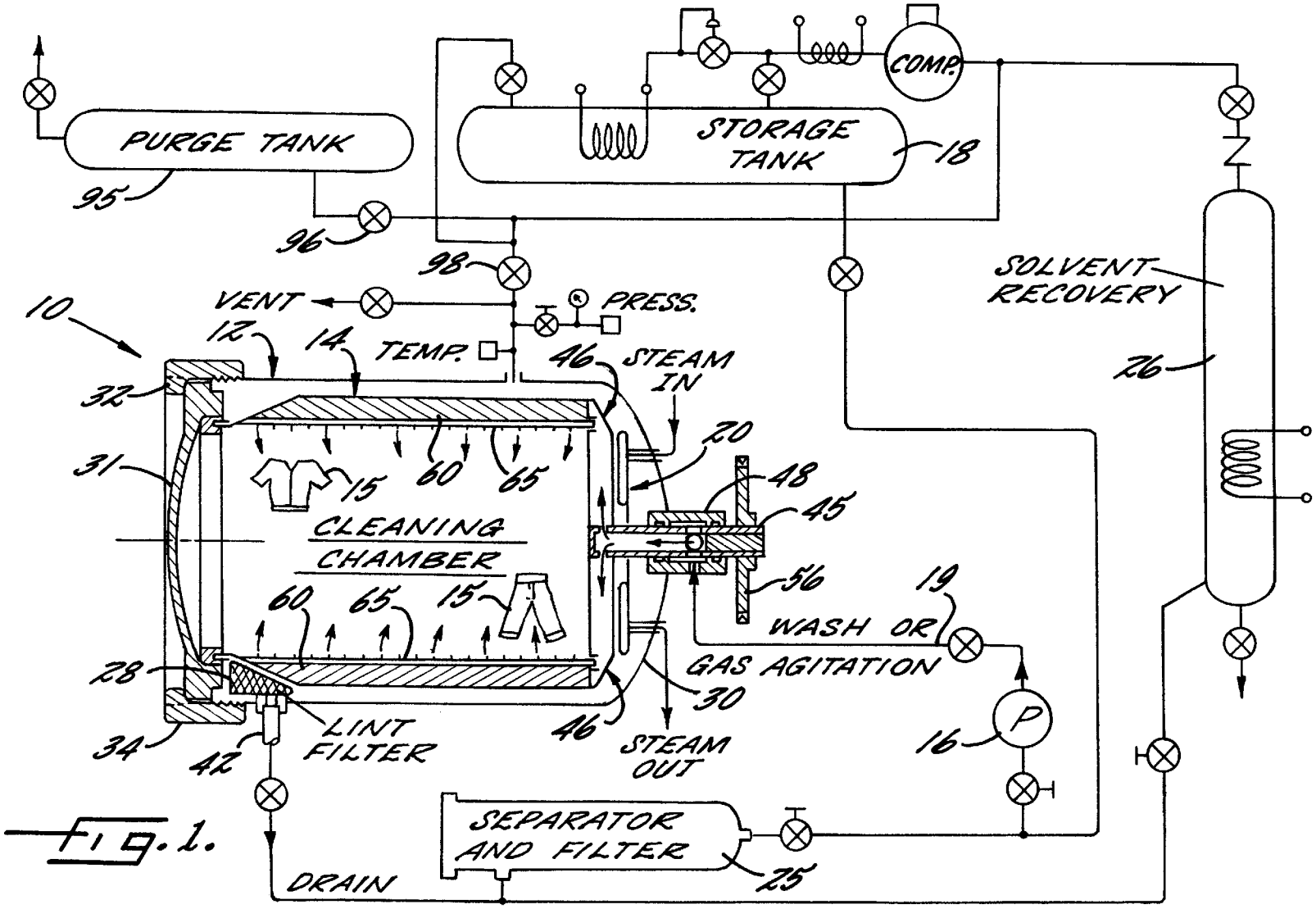
FIG. 1 is a schematic of a liquified gas dry-cleaning system in accordance with the invention.

While the invention is susceptible of various modifications and alternative constructions, a certain illustrated embodiment thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE DRAWINGS

Referring now more particularly to FIG. 1 of the drawings, there is shown a diagrammatic depiction of an illustrative liquified gas, dry-cleaning machine 10 embodying the present invention. In general, the dry-cleaning machine 10 includes a pressure vessel 12 having a perforated basket 14 disposed therein for containing items 15 to be cleaned. A liquid wash bath derived from a liquifiable gas, such as carbon dioxide, is used as the dry-cleaning solvent. A pump 16 is provided for directing the wash bath from a storage tank 18 and through an inlet line 19 into the pressure vessel 12. The pressure vessel 12 is equipped with a steam heater 20, pressure sensor 21, and temperature sensor 22 to aid in temperature and pressure control for properly maintaining the wash bath in liquid phase during the dry-cleaning cycle.

The basic operation of a liquid gas dry-cleaning system is known in the art, as reflected by U.S. Pat. Nos. 5,651,276, 5,467,492, and 5,651,276, the disclosures of which are incorporated herein by reference. After the basket 14 is loaded with items, such as garments, for cleaning, the pump 16 charges the vessel 12 with a wash bath drawn from the storage tank 18 which functions as the cleaning solvent during a drying cycle. Upon completion of the dry cleaning cycle, the wash bath is drained from the vessel and remaining wash bath vapors evacuated and re-liquified by an appropriate condenser for return to the storage tank.

For separating contaminants from the wash bath liquid following a cleaning cycle, the wash bath is cycled through a filtration and separator system 25 which functions to filter and vaporize the wash bath, thereby concentrating the particulate matter and other contaminants. The gaseous vapor is re-liquified in a condenser 26 for return to the storage tank 18. The pressure vessel 12 in this instance includes an internal lint filter 28 for removing gross solids and lint from the wash bath as it is drained from the pressure vessel, as disclosed in commonly assigned application Ser. No. 09/338,653, filed Jun. 23, 1999, the disclosure of which is incorporated herein by reference.

Figure 2:
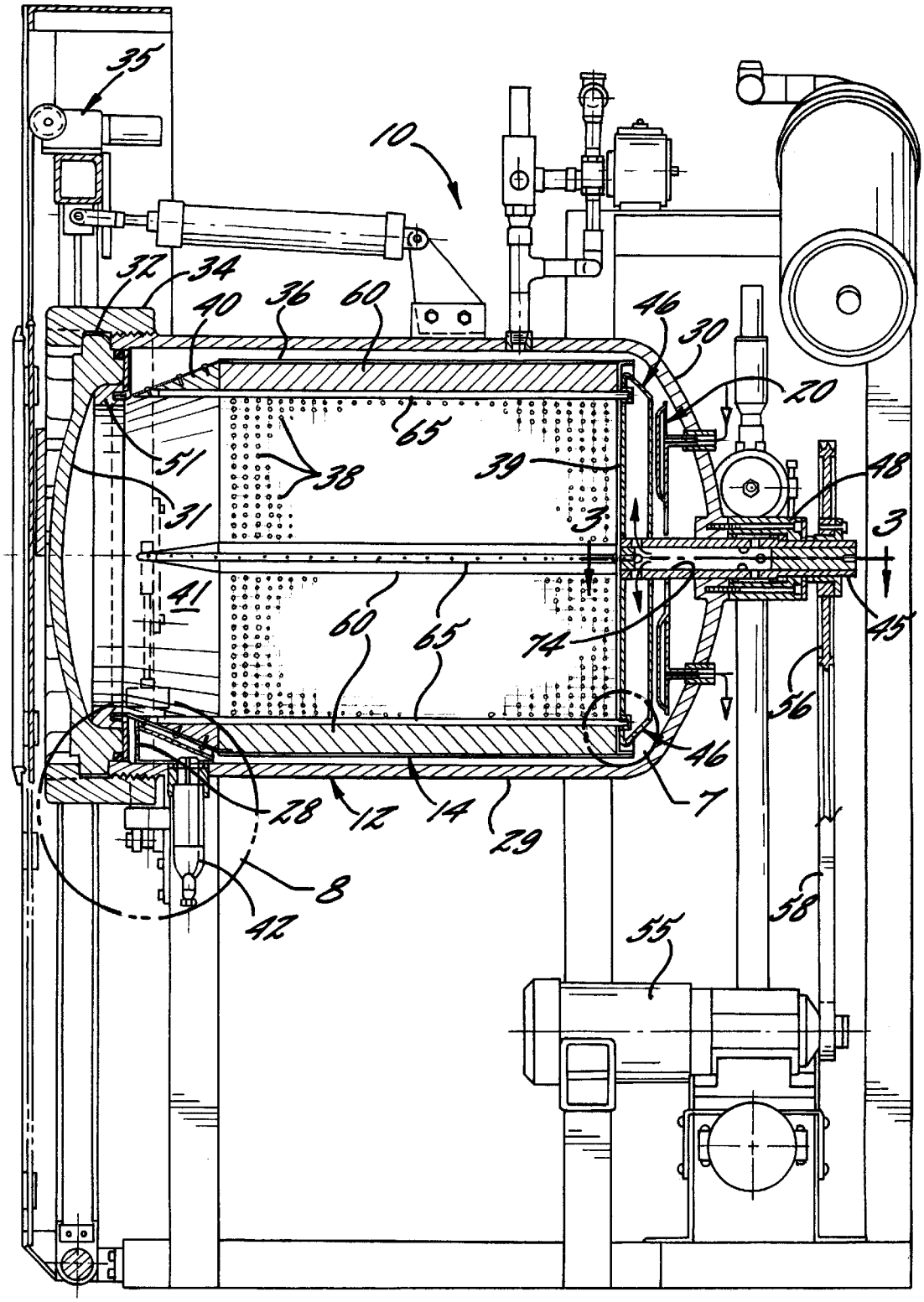
FIG. 2 is an enlarged longitudinal section of the dry-cleaning pressure vessel of the system shown in FIG. 1.

The illustrated pressure vessel 12, as best depicted in FIG. 2 comprises an elongated cylindrical housing having a rounded end wall 30 integrally formed at one end and a removable door 31, also of generally rounded configuration, releasably secured at the other end. The removable door 31 has an outer annular retaining flange 32 secured in abutting relation to the end of the cylindrical housing 29 by means of a locking ring 34 threadedly engaging the end of the cylindrical housing 29. For removing the door to permit loading and unloading of items into the cleaning vessel, an apparatus 35 may be provided for rotating the locking ring 34 to an unlocked position, and automatically removing and lowering the door 31, as disclosed in commonly assigned application Ser. No. 09/339,590 filed Jun. 23, 1999, the disclosure of which is incorporated herein by reference.

The basket 14 for receiving and containing items to be cleaned is substantially coextensive in length with the cylindrical housing 29 and has an outer cylindrical perforated sleeve 36, preferably made of stainless steel, which is formed with a plurality of longitudinal rows of openings 38 for enabling circulation of the liquid wash bath through the basket 14 during wash and rinse cycles. The perforated sleeve 36 is secured, such as by weldments, between a perforated back plate 39 and a conical front member 40 that defines a central inlet opening 41 to the basket 14 when the door 31 is opened. The internal lint filter 28 is disposed in a lower quadrant of the pressure vessel 12 below the conical front member 40 in communication with a drain 42 of the pressurized vessel 12.

Figure 8:
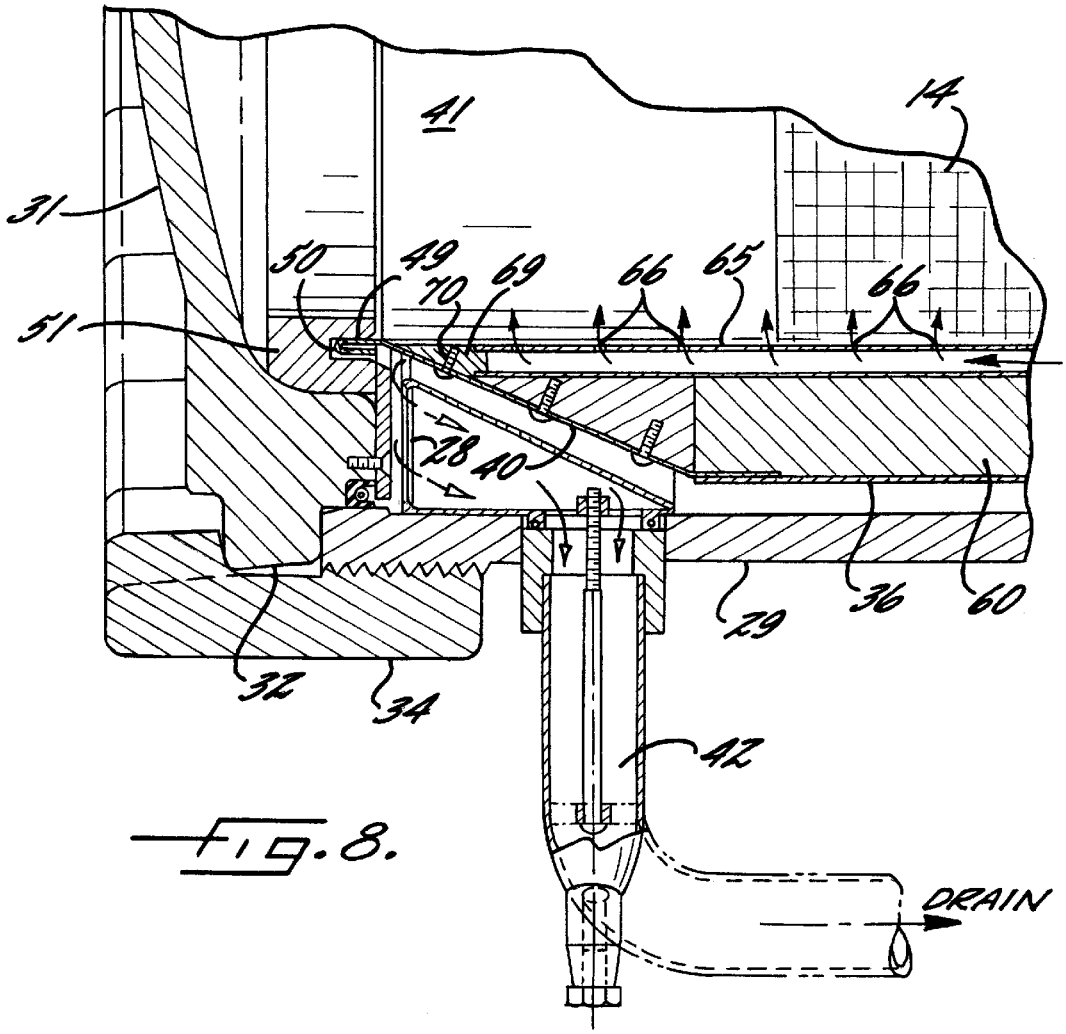
FIG. 8 is an enlarged fragmentary section of a downstream end of the basket, as encircled by the area referenced "8" in FIG. 2.

For supporting the basket 14 for rotating movement relative to the pressure vessel 12, the basket 14 has an outwardly extending support and drive shaft 45 extending through the pressure vessel end wall 30 and a spider-configured trunion 46 fixed to the shaft 45 and back plate 39. The drive shaft 45 is rotatably supported with an annular collar or bushing 48 affixed in outstanding relation to the end wall 30 of the pressure vessel by screws 47. For supporting the opposite end of the basket 14 for rotational movement when the door 31 is in a closed position, the conical front member 40 terminates in an annular ring 49 that is received and supported within a groove 50 of an annular pilot plate 51 fixed within an annular recess of door 31 (FIG. 8).

In order to rotate the basket 14 at selective speeds and rotary directions based upon the degree and type of agitation desired, a variable speed, bi-directional motor 55 is provided. The motor 55 drives a drive sheave 56 secured on the outwardly extended end of the basket support and drive shaft 45 via a V-belt 58.

Figure 6:
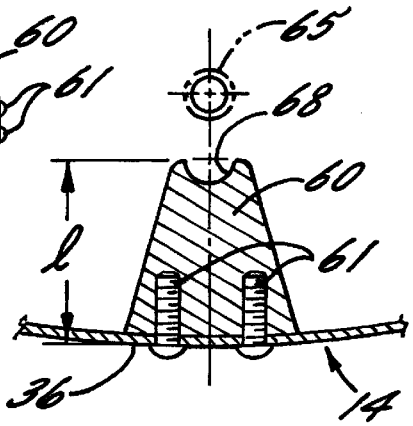
FIG. 6 is an enlarged fragmentary section showing the mounting of a rotary basket mixing baffles to the outer peripheral wall of the basket.

For enhancing agitation of items contained within the basket and the wash bath during cleaning, rinse and draining cycles, the basket 14 has a plurality of longitudinal mixing baffles 60, oriented parallel to the rotary axis of the basket 14, which extend radially inwardly from the outer periphery of the perforated sleeve 36. The longitudinal baffles 60 are disposed at circumferential spaced intervals within the basket 14 and extend between the end plate 39 and the conical front member 40. The baffles 60 preferably have an inwardly tapered or V-shaped configuration, as shown in FIG. 6, and are fixed to the inside surface of perforated sleeve 36 by screws 61. In order to provide adequate mechanical agitation of both items contained within the basket and the bath wash, the baffles 60 preferably have a radial length "l" that is at least 1/10 of the diameter of the basket.

It will be seen that upon rotation of the basket 14 through selected operation of the motor 55, the radially projecting baffles 60 will engage, mix, and agitate the wash bath and items contained in basket. The baffles 60 similarly turn and agitate items following a wash cycle to facilitate removal of liquified gas cleaning solvent. In that latter case, enhanced agitation of the items following a cleaning operation not only is effective for enhancing removal of the liquid solvent from the cleaned items, and hence shortening the draining/drying cycle, the mechanical and frictional agitation of the items during such process tends to raise the temperature of the items and offset a temperature drop that may occur by reason of evacuation of wash bath vapors from the pressure vessel during and at the end of the wash cycle, prior to removal of the items from the pressure vessel.

In accordance with an important aspect of the invention, to augment mechanical baffle agitation, a gas jet agitating system is provided which is operable for directing pressurized liquified gas jets or streams against evolving surfaces of items contained within the basket during a wash cycle as they are moved and turned as an incident to rotary basket movement. The illustrated gas jet agitation system includes a plurality of peripheral gas jet delivery manifolds 65 that each extend along the length of a respective mixing baffle 60. The illustrated manifolds 65 are in the form of tubes formed with a plurality of longitudinally spaced discharge orifices 66 for directing a plurality of pressurized liquified gas streams or jets into the basket 14 simultaneously with rotational movement of the basket. It will be understood that in an alternative to simplify the orifices 66 formed in the manifold tubes 65, individual spray nozzles could be mounted in the manifold tubes designed for imparting a desired spray characteristic.

In carrying out the invention, the manifold tubes 65 are protectively seated on radial ends of the baffles 60 in a manner that eliminates possible edges or crevices that might snag or damage items within the basket during cleaning. The radial ends of the baffles 60 in this instance each are formed with a respective U-shaped longitudinal channel or recess 68 of a diameter substantially similar to the diameter of the manifold tube 65, as depicted in FIG. 6. The manifold tubes 65 are disposed within the U-shaped channels 68 such that at least half of the tube 65 is effectively contained within the baffle channel 68, with the remaining circumferential portion of the tube defining the inner radial end of the baffle 65. The discharge openings 66 in the manifold tubes 65 preferably are oriented such that pressurized flow streams of liquified gas are directed radially into the basket during cleaning.

Figure 7:
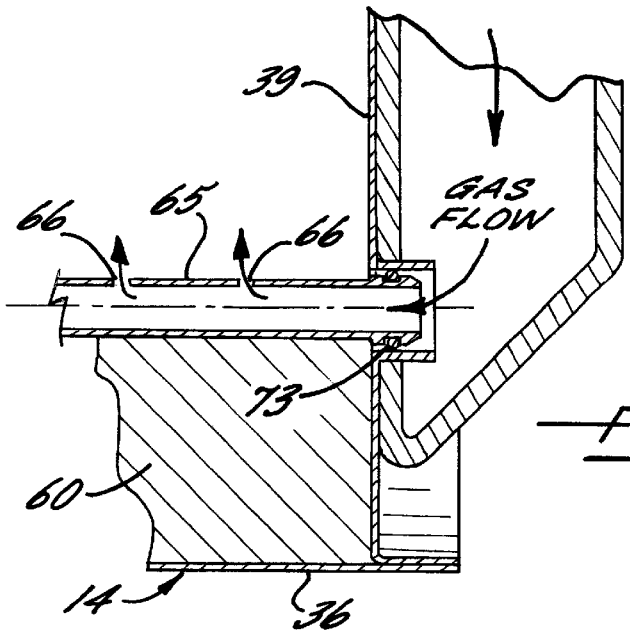
FIG. 7 is an enlarged fragmentary section of an upstream end of the rotary basket, as encircled with the area referenced "7" in FIG. 2.

It will be appreciated by one skilled in the art that since the manifold tubes 65 are not completely contained within the baffle 60, there is no need for forming the baffle 60 with apertures or slots, which would require alignment with the manifold orifices 66 during assembly. Instead, the manifold tubes 65 are simply assembled into the U-shaped panel channels and secured in place. For securing the ends of the manifold tubes 65 adjacent the removable door 31, a respective plug 69 is positioned into the end of each manifold tube 65 and secured to the conical front member 40 of the basket 14 by screws 70. For enabling the supply of pressurized liquid gas to the manifold tubes 65, the opposite, upstream ends of each manifold tube 65 is supported in sealed fluid communication with a respective hollow leg 72 of the spider-shaped trunion 46, which in turn communicate with a fluid passage 74 in the drive and support shaft 45. An O-ring 73 in this case provides the seal about the upstream end of each manifold tube 65 (FIG. 7). Not only are the manifold tubes 65 easily assembled on the baffles 60 by inserting the upstream ends into the spider legs 72 and securing the respective plug 70 to the front basket member 40, they are easily removable for periodic cleaning and/or replacement.

Figure 3:
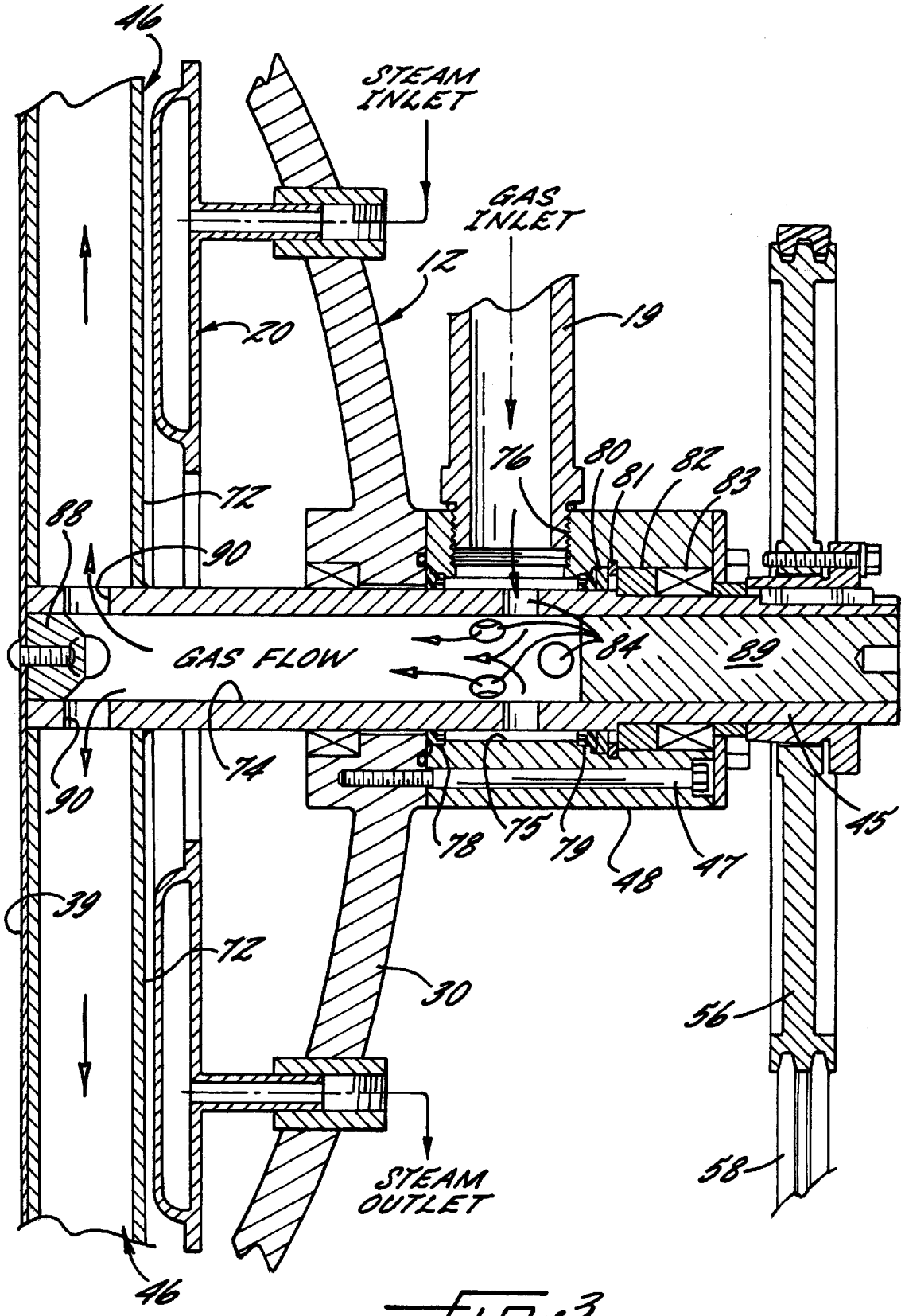
FIG. 3 is an enlarged fragmentary section taken along 3—3 in FIG. 2, showing the rotational mounting of the rotary basket shaft within the pressure vessel housing.
Figure 4:
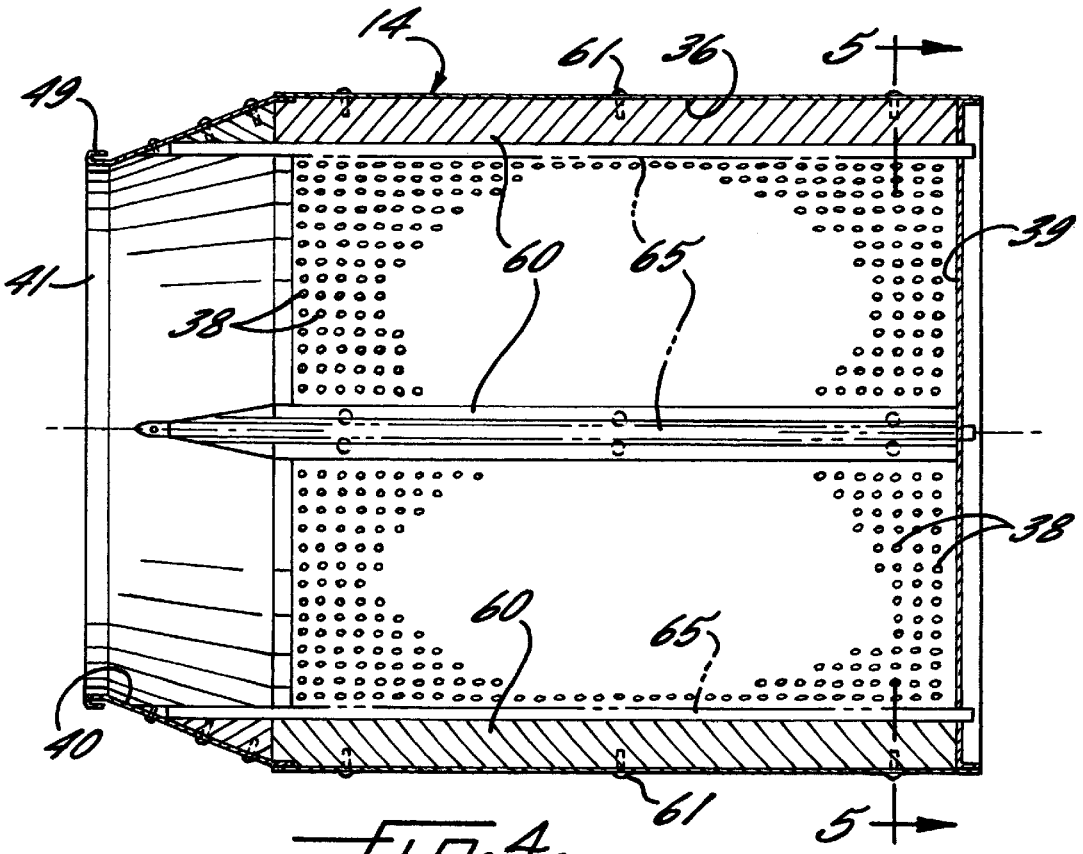
FIG. 4 is a longitudinal section of the rotary basket.
Figure 5:
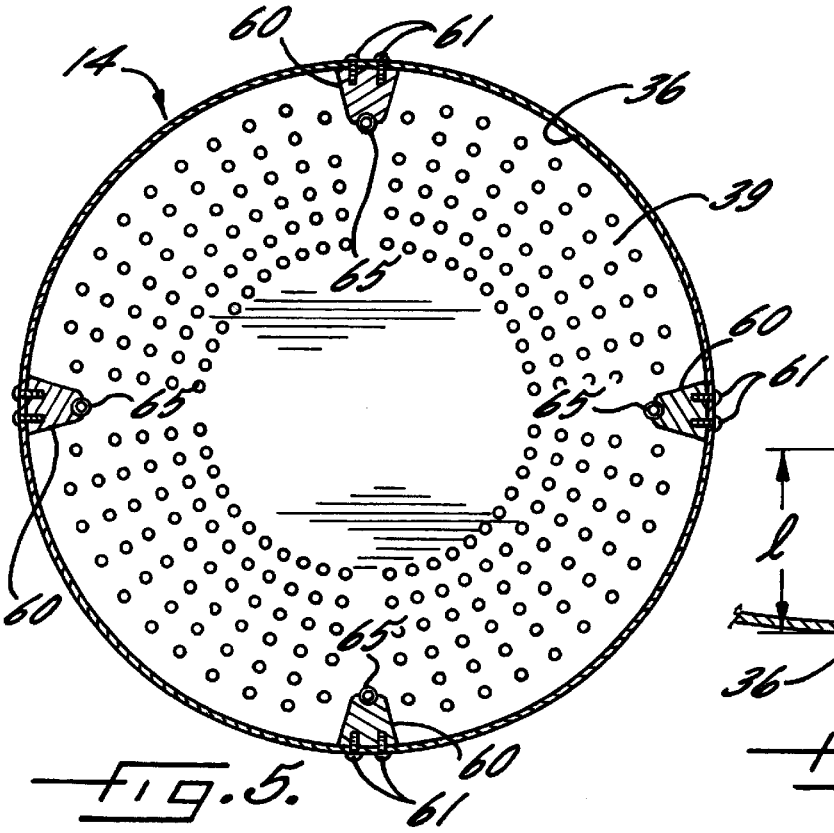
FIG. 5 is a vertical section of the rotary basket, taken in the plane of lines 5—5 in FIG. 4.

In order to supply pressurized liquified gas to the manifold tubes 65, the bushing 48 affixed to the end of the pressure vessel 12 defines an annular flow chamber 75 about a portion of the shaft 45 immediately adjacent the external side of the pressure vessel. The inlet line 19 from the liquid supply pump 16 is connected to and communicates with the annular chamber 75 via a threaded aperture 76 in the side of the bushing 48, as depicted in FIG. 3. The annular chamber 75 is sealed by lip seals 78, 79 interposed between the bushing 48 and shaft 45 at opposite axial ends of the annular chamber 75, and a radial washer 80, retainer ring 81, thrust bearing 82, and radial bearing 83 are disposed outboard of the lip seal 79 to accommodate axial and radial forces exerted by the drive shaft 45 by virtue of the high pressure within the vessel 12. The annular bearing and seal chamber 75 communicates through a plurality of radial apertures 84 in the drive shaft 45 with the shaft passage 74, which in this case is defined between end plugs 88, 89 secured in opposite ends of the tubular drive shaft 45. The drive shaft passage 74 in turn communicates through a plurality of radial apertures 90 in the drive shaft 45 with respective hollow legs 72 of the spider-shaped trunion 46, which in turn, as indicated above, each communicate with a respective manifold tube 65. It can be seen that liquified gas directed through the supply line 19 into the annular chamber 75, will enter the drive shaft passage 74, and be directed through the trunion legs 72 to the respective manifold tubes 65 for discharge in the form of a plurality of longitudinally spaced, radially directed, pressurized liquid gas flow streams.

Preparatory to a wash cycle, the pressure vessel 12 may be charged with a wash bath from the same liquified gas supply tank 18 and inlet manifolds 65 as used during gas agitation. During a wash cycle, the basket 14 preferably is driven in alternative rotary directions by the drive motor 55 to prevent tangling of items within the basket 14 and to facilitate evolving and turning movement of the items such that surfaces thereof continually are exposed and impinged by the liquified gas jets emitted from the circumferentially spaced gas jet agitation manifolds 65. While the liquified gas jet streams are radially emitted from the manifolds 65, it will be appreciated that rotary movement of the basket 14 imparts a tangential element of movement to the gas streams such that they in effect impinge the items at angles, which minimizes possible damage to fragile garments and the like within the wash basket. In practice, it has been found that effective agitation and cleaning is achieved when the basket 14 is rotated such that the baffles 60, and hence the manifolds 65 mounted thereon, are moving at a tangential speed of about 10 feet per second and the manifold apertures 66 are sized such that at a liquid discharge pressure, such as about 120 psi above the cleaning chamber pressure, the liquified gas jets are emitted from the manifolds 65 at about 100 feet per second. During such operation, surfaces of the continually moving and evolving items within the wash basket are repeatedly exposed to the liquified gas jet agitation. The combined agitation of both the wash bath and items contained therein from the baffles and liquid gas jets effectively increases contact of the wash bath with the garments for enhanced washing effectiveness. The contribution of the jets further is effective for physically dislodging and removing even very small sized insoluble soils, such as 2 to 3 microns in diameter and less.

As understood by those skilled in the art, cleaning effectiveness and efficiencies can be adversely affected by other factors, including the presence of air in the pressure vessel 12 and the liquified gas cleaning solvent. Air can be introduced into the system by entrapment within the fabric mesh of items deposited into the pressure vessel for cleaning. The presence of air in the liquified gas cleaning solvent can negatively impact the dry cleaning process by both diluting the cleaning fluid by creating pump cavitation, and air locking the underlocking system, the condensing system.

In accordance with a further aspect of the invention, the dry cleaning machine has a gas purging cycle of operation which facilitates more complete removal of entrapped air from items placed within the pressure vessel prior to charging the pressure vessel with the liquid carbon dioxide cleaning solvent. To this end, the purging cycle includes (a) introducing a pressurized gaseous carbon dioxide into the pressure vessel 12 while the pressure vessel is sealed; (b) rotating the basket to flex items contained therein so that the entrapped air is allowed to escape into the introduced gaseous $CO_2$; and (3) venting the gaseous $CO_2$ and released air from the pressure vessel. Preferably, the purging cycle is successively repeated up to 3 times, prior to introducing the liquid carbon dioxide wash bath into the pressure vessel for removing all but small traces of air from the contained items prior to cleaning.

In the illustrated embodiment, following loading of the pressure vessel with items to be cleaned and closing the door 31 to seal the washing chamber, gaseous carbon dioxide is directed from a purge tank 95 through a vent valves 96, 98 through the top of the pressure vessel 12 (FIG. 1). The gaseous carbon dioxide preferably is directed into the pressure vessel 12 at a pressure of about 30 psi (2 atmospheres) for approximately 3 seconds, the basket 14 is thereafter rotated for 3 seconds to turn, flex and mix the items within the basket sufficient to release at least a portion of air that is entrapped within the fabric mesh of the items, and thereafter, the introduced carbon dioxide gas and released air is vented to atmosphere for a similar short period of 3 seconds. Such purging cycle preferably is repeated two additional times to successively release and vent substantially all of the air entrapped within the items to be cleaned.

In practice, carrying out the purging cycle three successive times over a period of less than 30 seconds, has been found effective to remove more than 95% of the entrapped air. While the theory of operation of the purge cycle is not entirely understood, the following is believed to be the basis for its effectiveness. The purge process begins with the introduction of gaseous $CO_2$ at 2 atmosphere pressure into the closed cleaning chamber defined by the pressure vessel. After tumbling the garments, the mixture of 1 part air, 2 parts $CO_2$ is vented. The process is repeated with the reintroduction of 2 atmospheres of pure $CO_2$. The resulting venting mixture is 1 part air, 8 parts $CO_2$. A third repetition will generate a mixture within the cleaning vessel of 1 part air, 26 parts $CO_2$. the resulting amount of air relative to the total mixture is $(1/3)^n$ where $n$ is the number of purges. Hence, following the purge cycle, introduction of the liquified gas enables the cleaning cycle to efficiently carried out without appreciable air contamination.

From the foregoing, it can be seen that the liquified gas dry cleaning system of the present invention is adapted for faster and more efficient cleaning. The system includes a combined mechanical and gas jet agitation system which in combination enhances cleaning and shortens cycling times. The dry cleaning system, furthermore, is effective for preventing contamination of the liquified gas with air from items introduced into the pressure vessel for cleaning.

What is claimed is:

1. A liquified gas dry-cleaning system comprising:

a pressure vessel for containing a wash bath of a liquified gas under pressure.

a basket rotatably supported within the pressure vessel for containing items during cleaning;

a drive for rotating the basket within the vessel;

said basket having a plurality of baffles mounted on a periphery thereof and extending radially inwardly into said basket for physically contacting and agitating the wash bath and items contained within the basket during a dry-cleaning cycle as an incident to rotation of the basket;

a gas jet agitation system having a plurality of nozzles mounted on said basket; and a liquified gas supply operable for selectively directing liquified gas to said nozzles which in turn direct pressurized jet streams of liquified gas into the basket for further agitating the items contained within the basket and the liquid wash bath simultaneously with agitation by said baffles as an incident to basket rotation.

2. The liquified gas dry-cleaning system of claim 1 in which said baffles extend parallel to the rotary axis of said basket.

3. The liquified gas dry-cleaning system of claim 2 in which said baffles extend radially into the basket a distance of at least one-tenth the diameter of the basket.

4. The liquified gas dry-cleaning system of claim 1 in which said spray nozzles are defined by a plurality of manifold tubes disposed about the periphery of said basket.

5. The liquified gas dry-cleaning system of claim 4 in which said manifold tubes and baffles and manifold tubes extend parallel to the rotary axis of said basket.

6. The liquified gas dry-cleaning system of claim 4 in which said nozzles are defined by a plurality of axially spaced discharge apertures in said manifold tubes.

7. The liquified gas dry-cleaning system of claim 6 in which said apertures are configured for directing pressurized jet streams of liquified gas radially into said basket.

8. The liquified gas dry-cleaning system of claim 4 in which an inner radial end of each said baffle is formed with a recess, and said manifold tubes each are mounted within a respective baffle recess.

9. The liquified gas dry-cleaning system of claim 8 in which said baffle recesses are substantially U-shaped, and said manifold tubes each are mounted in a baffle recess with at least half of the circumferential periphery of the tube protectively contained within the recess.

10. The liquified gas dry-cleaning system of claim 9 in which said manifold tubes define inner radial ends of said baffles.

11. The liquified gas dry-cleaning system of claim 4 in which said baffles each have a substantially V-shaped cross section, and said manifold tubes are mounted at the apex of each said substantially V-shaped baffle.

12. The liquified gas dry-cleaning system of claim 4 in which said basket has a shaft supported for relative movement within said pressure vessel, a trunion supported by said shaft having a plurality of radially extending hollow legs each being in fluid communication with one of said manifold tubes, and said liquid supply is operable for directing pressurized liquified gas to said trunion for communicating liquified gas through said trunion legs to said manifold tubes.

13. The liquified gas dry-cleaning system of claim 12 in which said basket shaft is supported by an annular bushing mounted outwardly of said pressure vessel, said bushing defining an annular chamber about said shaft, said liquid supply being operable for directing liquified gas to said annular chamber, and said shaft being formed with an internal passage communicating with said annular chamber and said trunion legs for enabling communication of liquified gas from said annular chamber through said shaft passage, trunion legs, and manifold tubes.

14. The liquified gas dry-cleaning system of claim 12 in which one end of each said manifold tube is removably inserted into a respective one of said trunion legs, and the other end of each manifold tube has a removable plug mounted in the end therof and secured to a front portion of said basket.

15. The liquified gas dry-cleaning system of claim 4 in which said manifold tubes are removably mounted on said baffles.

16. The liquified gas dry-cleaning system of claim 1 in which said basket includes an outer cylindrical perforated sleeve, and said baffles are mounted in inwardly extending relation to said perforated sleeve.

17. The liquified gas dry-cleaning system of claim 1 in which said pressure vessel includes a door mounted for movement between open and closed positions, said basket having a support shaft extending outwardly through said pressure vessel from one end of said basket, and the other end of said basket defining an entry opening through which items may be loaded into the basket when said door is in an open position.

18. The liquified gas dry-cleaning system of claim 17 in which said other end of said basket defines an annular ring, and said door being formed with an annular recess for receiving and supporting said basket for relative rotational movement when said door is in a closed position.

19. The liquified gas dry-cleaning system of claim 18 in which said other basket end has a conical form which terminates in said ring and which defines said front entry opening.

20. A liquified gas dry-cleaning system comprising:

a pressure vessel for containing a wash bath of a liquified gas under pressure;

a basket rotatably supported within the pressure vessel for containing items during cleaning;

a drive for rotating the basket within the vessel;

a gas jet agitation system having a plurality of nozzle mounted on said basket;

a liquified gas supply operable for selectively directing liquified gas to said nozzles which in turn direct pressurized jet streams of liquified gas into the basket for agitating the items contained within the basket and the liquid wash bath;

said pressure vessel including door mounted for movement between open and closed positions;

said basket having a support shaft extending outwardly through said pressure vessel from one end of said basket, the other end of said basket having an annular ring defining an entry opening through which items may be loaded into he basket when said door is in an open position; and said door being formed with an annular recess for receiving and supporting said annular ring of the basket for relative rotational movement when said door is in a closed position.

21. The liquified gas dry-cleaning system of claim 20 in which said basket has a conical end which terminates in said ring.

22. A liquified gas dry-cleaning system comprising:

a pressure vessel for containing a wash bath of a liquified gas under pressure;

a basket rotatably disposed within the pressure vessel for containing items during cleaning;

said basket having a shaft supported for rotation relative to said pressure vessel;

a drive for rotating said shaft and basket;

a gas jet agitation system having a plurality of manifold tubes mounted on said basket;

said manifold tubes having a plurality of spaced apart discharge orifices;

a trunion supported by said shaft having a plurality of radially extending hollow legs each being in fluid communication with one of said manifold tubes; and a liquified gas supply operable for selectively directing liquified gas to said trunion for communicating liquified gas through said trunion legs to said manifold tubes which in turn direct pressurized jet streams of liquified gas through said discharge orifices into the basket for agitating the items contained within the basket and the liquid wash bath during a dry-cleaning operation.

23. The liquified gas dry-cleaning system of claim 22 in which said basket shaft is supported by an annular bushing mounted outwardly of said pressure vessel, said bushing defining an annular chamber about said shaft, said liquid supply being operable for directing liquified gas to said annular chamber, and said shaft being formed with an internal passage communicating with said annular chamber and said trunion legs for enabling communication of liquified gas from said annular chamber through said shaft passage, trunion legs, and manifold tubes.

24. The liquified gas dry-cleaning system of claim 22 in which one end of each said manifold tube is removably inserted into a respective one of said trunion legs, and the other end of each manifold tube has a removable plug mounted in an end thereof and secured to a front end portion of said basket.

25. A liquified gas dry-cleaning method using a pressure vessel having an internal basket for containing items to be cleaned comprising the steps of introducing items to be cleaned into said basket, sealing said pressure vessel, introducing into said vessel under pressure a liquified gas wash bath, rotating said basket to agitate the wash bath and items contained therein during a cleaning cycle, and directing a plurality of pressurized jet streams of liquified gas into said basket from a plurality of discharge orifices located within said basket for causing higher velocity movement of the liquid wash bath and items contained therein simultaneously with agitation as an incident to basket rotation during a cleaning cycle.

26. The method of claim 25 including repeatedly reversing the direction of rotary movement of said basket during the cleaning cycle.

27. The liquified gas dry-cleaning method of claim 25 including directing pressurized jets of liquified gas into said basket by directing liquified gas through a plurality of manifold tubes mounted on said basket for rotation therewith.

28. The liquified gas dry cleaning system of claim 25 in which during each air purge cycle the gaseous form of the liquified gas is introduced into said pressure vessel at a pressure of about 30 psi.

29. A liquified carbon dioxide gas dry-cleaning method using a pressure vessel having a internal basket for containing items to be cleaned comprising the steps of:

introducing items to be cleaned into said basket;

sealing the pressure vessel;

carrying out an air purge cycle by introducing under pressure a gaseous form of carbon dioxide into said pressure vessel, rotating said basket so that items within the basket are turned and flexed to release at least a portion of any contained air therein, venting the introduced carbon dioxide gas and released air from the pressure vessel;

repeating the air purge cycle at least one additional time;

re-sealing the pressure vessel following the final gas purge cycle; and carrying out a dry-cleaning cycle by introducing under pressure a wash bath of liquified carbon dioxide gas into the pressure vessel, and rotating the basket to agitate the contained items and wash bath during the dry cleaning cycle.

30. The liquified carbon dioxide dry cleaning method of claim 29 including repeating said air purge cycle three times prior to carrying out the dry-cleaning cycle.

31. The liquified carbon dioxide gas dry-cleaning method of claim 29 in which during each air purge cycle gaseous carbon dioxide is introduced into said pressure vessel for about three seconds, the basket is rotated for about three seconds, and the gaseous carbon dioxide and released air is vented for about three seconds.

32. The liquified carbon-dioxide gas dry-cleaning method of claim 29 in which during each air purge cycle the gaseous carbon dioxide is introduced into said pressure vessel at a pressure of about 30 psi.

33. The liquified carbon dioxide gas dry cleaning method of claim 29 including the step of introducing pressurized streams of liquified carbon dioxide gas into said basket simultaneously as the basket is rotated during a dry cleaning cycle to augment agitation and cleaning of items contained therein.

34. A liquified gas dry-cleaning method using a pressure vessel having an internal basket for containing items to be cleaned comprising the steps of introducing items to be cleaned into said basket, sealing said pressure vessel, introducing into said vessel under pressure a liquified gas wash bath, rotating said basket to agitate the wash bath and items contained therein during a cleaning cycle, directing a plurality of pressurized jet streams of liquified gas into said basket for causing higher velocity movement of the liquid wash bath and items contained therein simultaneously with agitation as an incident to basket rotation during a cleaning cycle, carrying out an air purge cycle prior to introducing the liquified gas wash bath into the pressure vessel, said air purge cycle including the steps of introducing into said vessel under pressure of a gaseous form of the liquified gas which makes up the wash bath, rotating the basket so that the items within the basket are turned and flexed to release at least a portion of any contained air therein, venting the introduced gas and released air from the pressure vessel, and repeating the gas purge cycle at least one additional time.

* * * * *